US008777053B2

(12) United States Patent
Bunoz

(10) Patent No.: US 8,777,053 B2
(45) Date of Patent: Jul. 15, 2014

(54) SHEETS DISPENSER

(75) Inventor: Etienne Vincent Bunoz, Eastbourne (GB)

(73) Assignee: Brightwell Dispensers Limited, Newhaven (GB)

( * ) Notice: Subject to any disclaimer, the term of this patent is extended or adjusted under 35 U.S.C. 154(b) by 973 days.

(21) Appl. No.: 12/308,368

(22) PCT Filed: May 15, 2007

(86) PCT No.: PCT/GB2007/001789
§ 371 (c)(1),
(2), (4) Date: Oct. 19, 2009

(87) PCT Pub. No.: WO2007/144558
PCT Pub. Date: Dec. 21, 2007

(65) Prior Publication Data

US 2010/0032445 A1 Feb. 11, 2010

(30) Foreign Application Priority Data

Jun. 13, 2006 (GB) ..... 0611694.1

(51) Int. Cl.
*B65D 83/08* (2006.01)

(52) U.S. Cl.
USPC ..... 221/45; 221/34; 221/61; 221/306

(58) Field of Classification Search
USPC ..... 221/45, 61–63, 281, 303, 306
See application file for complete search history.

(56) References Cited

U.S. PATENT DOCUMENTS

| | | | | |
|---|---|---|---|---|
| 2,338,604 | A * | 1/1944 | Silveyra | 229/117.3 |
| 3,252,632 | A * | 5/1966 | Hagenes | 222/449 |
| 3,986,479 | A * | 10/1976 | Bonk | 118/506 |
| 4,240,271 | A * | 12/1980 | Brownlow | 62/457.2 |
| 4,790,436 | A | 12/1988 | Nakamura | |
| 5,469,987 | A | 11/1995 | Honkawa | |
| 5,516,001 | A * | 5/1996 | Muckenfuhs et al. | 221/63 |
| 5,715,971 | A * | 2/1998 | Morand | 221/45 |
| 5,718,353 | A * | 2/1998 | Kanfer et al. | 221/63 |
| 6,158,614 | A * | 12/2000 | Haines et al. | 221/63 |
| 6,220,435 | B1 * | 4/2001 | Nobile et al. | 206/409 |
| 6,299,027 | B1 * | 10/2001 | Berge et al. | 222/153.14 |
| 6,431,380 | B1 * | 8/2002 | Branson | 215/206 |
| 6,634,037 | B2 | 10/2003 | Turbett | |
| 6,899,250 | B2 * | 5/2005 | FitzSimons et al. | 221/45 |
| 6,948,643 | B1 * | 9/2005 | Lohrman | 222/556 |
| 2004/0173635 | A1 * | 9/2004 | Bunoz | 222/183 |
| 2005/0067313 | A1 * | 3/2005 | Banik et al. | 206/494 |
| 2006/0118567 | A1 * | 6/2006 | Linnebur | 221/45 |
| 2006/0157496 | A1 * | 7/2006 | Tagliareni | 221/63 |
| 2006/0283873 | A1 * | 12/2006 | Bostic | 221/33 |

FOREIGN PATENT DOCUMENTS

| | | |
|---|---|---|
| EP | 0 502 751 | 9/1992 |
| EP | 0 748 748 A1 | 12/1996 |
| EP | 1 000 577 | 5/2000 |
| GB | 1 406 124 | 9/1975 |
| WO | WO 01/05679 A1 | 1/2001 |

* cited by examiner

*Primary Examiner* — Gene Crawford
*Assistant Examiner* — Kelvin L Randall, Jr.
(74) *Attorney, Agent, or Firm* — Levy & Grandinetti

(57) ABSTRACT

A sheets dispenser comprising a container with an opening, and a spring loaded lid adapted to close say opening, in which the opening is provided with extrusion means, and in which the lid is biased into a closed position.

28 Claims, 5 Drawing Sheets

65
62
54
53
52
59
60
61
55
50
51
57
56
58
63
64

SHEETS DISPENSER

The Applicant claims priority to International Application No. PCT/GB2007/001789, filed on May 15, 2007, and Great Britain Application No. GB-A-0611694.1 filed on Jun. 13, 2006.

This invention relates to a sheets dispenser, for use particularly, but not exclusively, to dispense wet wipes.

Wet wipes are sheets of a fabric material infused with a cleansing fluid, and they have multiple uses. One of the most common applications are wet wipes for cleaning parts of the human body, for example the hands or face, or for use as toilet paper or baby wipes. In such cases the cleansing fluid can be a soap or other chemical detergent suitable for the purpose. Wet wipes are also used to clean domestic surfaces, and other installations, and in such cases the fabric is often heavier and the cleansing fluid formulated accordingly.

Wet wipes can dry out if left exposed to air for too long. Therefore, they are often packaged in a container with an opening provided with a sealable lid, which can be shut when the wipes are not required. These containers can be something as simple as an outer wrapper made from a flexible plastics material, which has an access opening formed in one side with a peelable and re-usable sticky-backed lid. Such containers are single use and are disposed of when the wipes run out. Alternatively, it is known to provide a re-usable box formed from a rigid plastics material, which has an opening with a rigid hinged lid. Such boxes have a top which can be removed, or which is hinged to the body of the box, so they can be opened and refilled with wipes. The wipes can be loose, or they can be inside an outer wrapper as described above. The opening with the lid is provided in the top.

However, these known examples of containers are very simple in construction and the lids often fail to provide an adequate air seal, and as a result the wipes closest to the opening can dry out. In addition, the user must close the lid manually, and if they forget to do so the wipes will also dry out.

It is common to package wet wipes such that when one is removed from a container, a portion of the next can be left protruding from the opening so it can be readily accessed. To achieve this the wet wipes can be connected together in a sequence and means can be provided to break the connection when one wipe is fully removed and the next is partially removed.

This can be achieved by arranging the wet wipes in an overlapping sequence and providing a resistance of some kind at the opening. The sheets can be folded together or attached with an adhesive, and a force required to break this connection can be less than the resistance at the opening. Thus, when a sheet is pulled through the opening it pulls the overlapping section of the next sheet through before disconnecting from it. This leaves a convenient section of the next sheet protruding from the opening ready to be removed. The resistance can be provided by shaping or dimensioning the opening such that it forms an extrusion means.

However, arranging wet wipes in such an overlapping sequence can increase the costs of the packaging process. A cheaper alternative is to manufacture a length of wet wipe material, and provide perforated lines in it, such that a sequence of sheets is provided which are connected end to end.

With such an arrangement it is not sufficient to have a resistance at the opening which is greater than the force required to separate the sheets, as they would separate as soon as one exited the opening, and little or no part of the next sheet would be left protruding. Therefore when sheets are connected end to end in this way, the force required to separate the sheets can be greater than the resistance, and the sheets can be separated by applying such a greater force when one sheet is clear and another protrudes partly from the opening. A greater force can be applied by pulling on the sheet with a quick movement.

However, it is also possible to employ an extrusion means which is shaped or arranged such that different amounts of resistance can be provided. In the first instance the level of resistance can be less than the force required to separate the sheets, such that a first sheet and a portion of a second sheet can be pulled therethrough, and in a second instance the level of resistance can be greater than the force required to separate the sheets, so they can then be separated. This can be achieved by simply pulling the sheets through at different angles to the opening, or by having an opening with a section which tapers to one side, such that a sheet can be pulled with low resistance from a central part of the opening, and a greater resistance can be provided if the sheet is pulled laterally into the tapering section.

However, the extrusion means employed to facilitate these features can rapidly wear out and fail. Often they are only round openings formed in panels constructed from a flexible plastics material. In addition, the section of sheet left protruding from the opening can foul the operation of the sealable lid, either by preventing its closure completely, or becoming trapped between the lid and the container.

When re-usable boxes are used, it can be awkward to thread the first wipe through the opening. When a packet of wipes is placed in the box, the first one must be partially withdrawn from it, then threaded through the box's opening from underneath. This is awkward because the packet and the box are not physically connected to one another, and the box's opening is in the top, which is rotated away from the inside of the box when it is open.

The present invention is intended to overcome some of the above problems.

Therefore, according to a first aspect of the present invention a sheets dispenser comprises a container with an opening, and a spring loaded lid adapted to close said opening, in which the opening is provided with extrusion means, and in which the lid is biased into a closed position.

(The term "sheets" used herein refers to any sheets of material which can be dispensed from a dispenser, and not only wet wipes, although preferably the dispenser can be for dispensing wet wipes.)

Thus, in its simplest form the invention can be a wet wipe dispenser which shuts automatically, thereby preventing any wipes from drying out.

In a preferred construction the dispenser can comprise a mounting means depending inwardly from said opening, which can be adapted to co-operate with an aperture of an inner container with which the sheets dispenser can be used, such that the inside of the inner container is accessible through the opening.

Thus, the invention provides for a system in which an inner container carrying the wipes can be physically mounted to an underside of the opening, so the first wipe can be readily pulled through the opening in use.

The mounting means can comprise a substantially cylindrical boss adapted to co-operate with a substantially cylindrical collar provided in the aperture of the inner container. Preferably the boss can be a snap-fit with the collar.

As referred to above, wet wipes come in a number of varieties for a number of different purposes, and the dispenser of the invention can be used to dispense any of them. However, in some circumstances a number of different dispensers may be provided on one site, and it may be important to ensure that the correct type of wet wipes are installed into the particular dispensers.

Therefore, in one construction the boss can be provided with a shaped profile adjacent its lower edge, which can be adapted to co-operate with a corresponding shaped profile provided on the collar of the inner container. With this arrangement only the correct specification of inner container can be fitted to the dispenser. In addition, this feature allows providers of the dispensers to prevent any competitor's wipes from being used, as they will not fit onto the mounting means.

In one construction the boss can be provided with an indicator adapted to align with an indicator provided on said collar when said shaped profiles are aligned for co-operation. The boss can also be tapered to enhance the smooth co-operation between it and the collar.

As stated above the opening is provided with extrusion means. The term "extrusion means" used herein refers to an opening which is of such dimensions or shape that a force is required to pull a sheet through it. It will be appreciated that the extrusion means of the invention will only function as such when the sheets are orientated or conditioned within the inner container such that a force is required to pull them through the extrusion means. As a wet wipe is flexible it would be possible to fold one up so it passed through the opening unrestricted. However wet wipes are generally packaged flat or in a roll, and as such it requires a force to pull them through an extrusion means arranged above them.

In a preferred construction the opening can carry a panel, and the extrusion means can comprise a shaped aperture formed in the panel. The shaped aperture can be adapted to restrict the passage of a sheet to be dispensed. Preferably the shaped aperture can be so shaped as to provide different levels of resistance at different sections. This can be achieved by having at least one tapering section. With such an arrangement the invention can be used with wet wipes connected together end to end as described above.

In one construction the panel can only partly overlie the opening, such that a open passage way is provided adjacent the panel. This feature allows a user to readily access the inside of the inner container, once the inner container is mounted on the mounting means. Thus, an inner container can be mounted inside the dispenser, then the user can access the first wet wipe through the open passage, and feed it though the extrusion means from below.

Preferably the panel can be removable from said opening. This feature allows the extrusion means to be replaced if it wears out in use. It also allows differently shaped extrusion means adapted for use with different types of wet wipes to be used in the same dispenser. It also allows the extrusion means to be removed from the opening to access the contents of the inner container if necessary.

The opening can comprise a frame adapted to carry the panel, and the panel can be resilient, and be removable from the frame when it is placed under compression. Further, the shaped aperture can be substantially star shaped, and it can overlap with an edge of the panel, such that a lateral opening in the aperture can be formed, which lateral opening can be at least partially collapsible. Thus, the panel can be placed under compression to fit or remove it from the frame by applying a lateral force and collapsing the lateral opening.

The panel can be provided with a downwardly depending edge wall along its peripheral edge, an upper laterally extending flange at a top of said edge wall, and a lower laterally extending flange at a bottom of said edge wall, such that a trough is formed which is adapted to receive a peripheral edge portion of said frame. In addition, one or more lugs can extend from the upper flange to the lower flange, and the peripheral edge portion of the frame can comprise one or more sockets adapted to receive the one or more lugs. With this construction the panel can be securely fastened to the frame at a predetermined rotational position.

Preferably the opening itself can comprise a passageway extending from a top, which is closable with the lid, to the mounting means. The panel can be disposed at a bottom end of the passageway, such that a chamber is provided between the lid and the panel when the lid is in a closed position. This feature helps to prevent a wet wipe extending from the extrusion means from fouling the lid in use, as it can be contained within this chamber.

It will be appreciated from the above that it must be possible to open the container in order to mount the inner container to the mounting means therein. Therefore, in a preferred construction the container can comprise a base and a cover hinged thereto. The opening can be provided on the cover.

Preferably the container can be generally shaped as a rectangular box with a top side, a bottom side, a front side, a back side, a left side and a right side. The base can comprise at least said back side and said bottom side, and the cover can comprise at least said front side and said top side, and the cover can be hinged to the base adjacent an edge where the bottom side and the front side meet. The opening can be provided on the top side.

In one construction the base can comprise a first part of the left side and a first part of the right side, and the cover can comprise a second part of the left side which overlaps with said first part of the left side when the container is shut, and a second part of the right side which overlaps with said first part of the right side when the container is shut. The back side of the base can be wall mountable. Such a container has an expedient and attractive construction.

Preferably the lid can extend to an edge where the top side and the front side meet, and a concavity can be provided on the front side underneath said edge. This allows the lid to be readily lifted from below.

As described above the lid is biased into a closed position, and in a preferred construction the lid can be mounted to the container by spring loaded hinge means, which can comprise a pair of laterally spaced sockets provided on the container, a sleeve provided on the lid disposed between said sockets and axially aligned thereto, and a spring loaded pinion disposed in said sockets and said sleeve. The pinion can be non-rotatably attached to the sleeve, and a coil spring can be attached at a first end to one end of the pinion. A tension plug can be attached to a second end of the spring, and the tension plug can be non-rotatably attached to the cover. Thus, the coil spring can be kept under tension to provide the spring biasing feature. This construction allows the components to be constructed easily, and it also allows the tension to be adjusted by disconnecting the tension plug from the cover and rotating it.

The pair of laterally spaced sockets, the pinion, the coil spring and the tension plug can all be carried on a main frame attached to the cover. This main frame can be removably attached to the cover in a snap-fit arrangement. Again, this allows for a ready construction of the components.

It will be appreciated that with the above described construction of the spring loaded hinge means the tension plug is arranged laterally to the opening. In a preferred construction the main frame can fit into a trough formed in the cover, and as such, when the main frame is attached to the cover the tension plug cannot be accessed. Thus, the main frame can be removed to access the tension plug and adjust it if necessary.

The main frame can also carry the mounting means and the extrusion means.

It will be appreciated that in use the dispenser will carry an inner container. Thus, in a preferred construction the dispenser can be provided with an inner container mounted to the mounting means, which inner container can contain sheets to be dispensed.

These sheets to be dispensed can be connected to one another in a sequence by connection means. In one version of the invention the sheets can be arranged in an overlapping sequence and the connection means can comprise portions of the sheets folded together, or it can comprise an adhesive. With such an arrangement a force required to sever the connection means can be less than a force required to pull a sheet through the extrusion means. Thus, when one wet wipe is removed in use, a portion of the next will be pulled through the extrusion means, before the connection means is severed, which leaves a convenient portion of the next wet wipe extending from the extrusion means ready to be gripped for removal.

However, in an alternative and preferred construction the sheets can be formed from a length of material with perforated lines formed therein, such that a sequence of sheets are provided which are connected to one another end to end. In order to leave a convenient portion of the next wet wipe protruding from the opening as described above, the extrusion means can be adapted such that in a first instance a first level of resistance is provided which is less than the force required to separate the sheets, such that a first sheet and a portion of a second sheet can be pulled therethrough, and in a second instance the level of resistance can be greater than the force required to separate the sheets, so they can then be separated As referred to above, preferably the extrusion means can be substantially star-shaped, and as such it has at least one tapering section. This construction allows for the above described first and second levels of resistance. In the first instance the sheets can be pulled through the middle of the star shape, which can be done most readily if they are pulled straight upwards, and in the second instance the sheets can be pulled through the tapering section, which can be done most readily if the sheets are pulled laterally into the tapering section.

As referred to above, preferably the sheets can be wet wipes.

The invention also includes an inner container specifically adapted for use with a dispenser as described above.

Therefore, according to a second aspect of the present invention an inner container for use solely with a sheets dispenser as described above, in which the inner container comprises an aperture maintained by a substantially cylindrical collar, in which said collar is adapted to mount to a mounting means of said sheets dispenser, and in which the inner container contains sheets to be dispensed The collar can also be provided with a shaped profile adapted to co-operate with a corresponding shaped profile provided on the mounting means.

As above, the sheets to be dispensed can be connected to one another in a sequence by connection means, and they can be adapted to be separated by extrusion means on the sheets dispenser in any of the manners described above.

The invention can be performed in various ways, but one embodiment will now be described by way of example and with reference to the accompanying drawings, in which.

Figure 1:
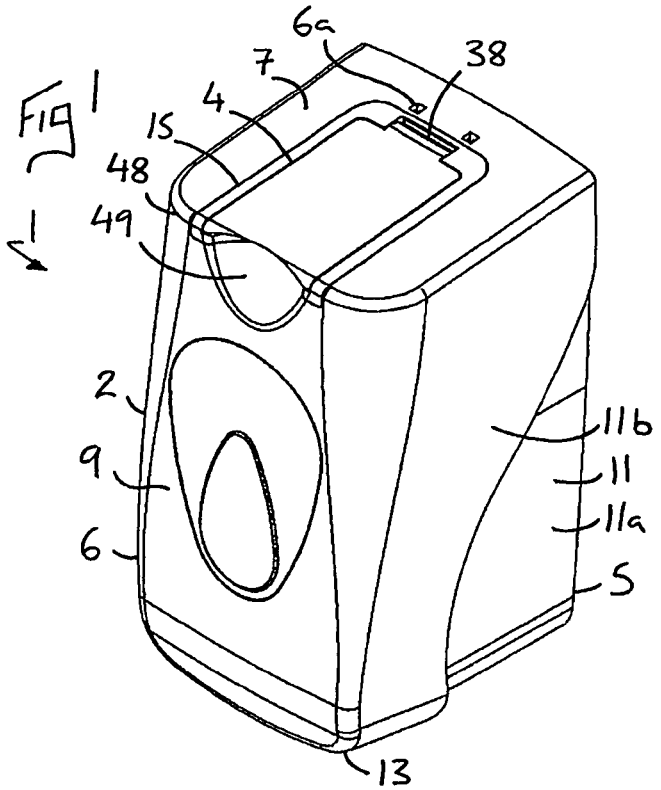
FIG. 1 is a perspective view of a sheets dispenser according to the first aspect of the present invention.
Figure 3:
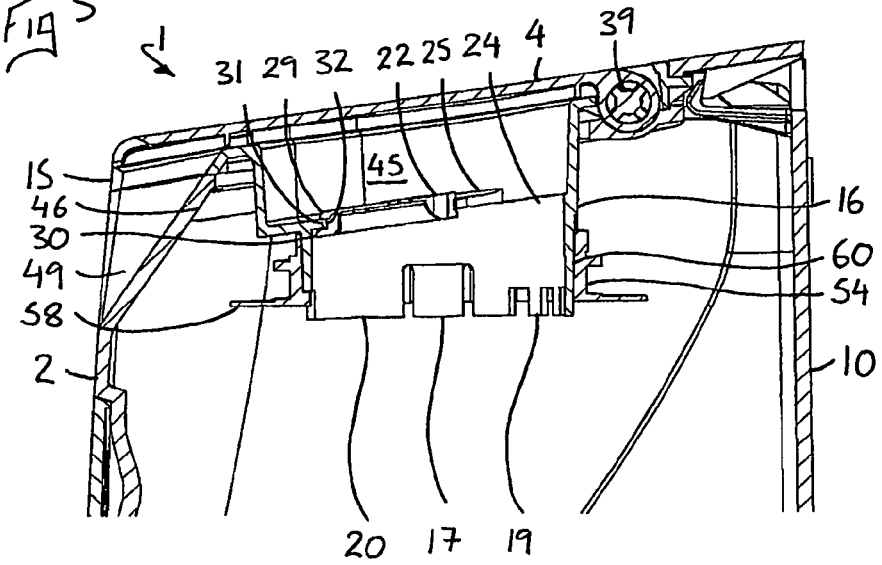
FIG. 3 is a part cross-sectional side view of the dispenser as shown in FIG. 1.

As shown in the Figures the a sheets dispenser, in the form of wet wipes dispenser 1, comprises a container 2 with an opening 3 and a spring loaded lid 4 adapted to close said opening 3, in which the lid 4 is biased into a closed position, as shown in FIGS. 1 and 3.

The container 2 is a generally rectangular shaped box comprising a base 5 and a cover 6 hinged thereto. The container comprises a top side 7, a bottom side 8, a front side 9, a back side 10, a left side 11 and a right side 12. The base 5 comprises the back side 10, the bottom side 8, a first part 11*a* of the left side 11, and a first part 12*a* of the right side 12. The cover 6 comprises the front side 9 the top side 7, a second part 11*b* of the left side 11 which overlaps with said first part 11*a* when the container 1 is shut as shown in FIG. 1, and a second part 12*b* of the right side 12 which overlaps with said first part 12*a* when the container 1 is shut.

The cover 6 is hinged to the base 5 via hinge means (not visible) adjacent the edge 13 where the bottom side 8 and the front side 9 meet. The base 5 is provided with resilient catches 5*a* at the top of the back side 10, which co-operate in use with slots 6*a* in the top side 7 of the cover 6, to fasten the cover 6 to the base 5 as shown in FIG. 1. The back side 10 has apertures 14 formed therein so the container 2 can be mounted on to a wall (not shown).

Figure 2:
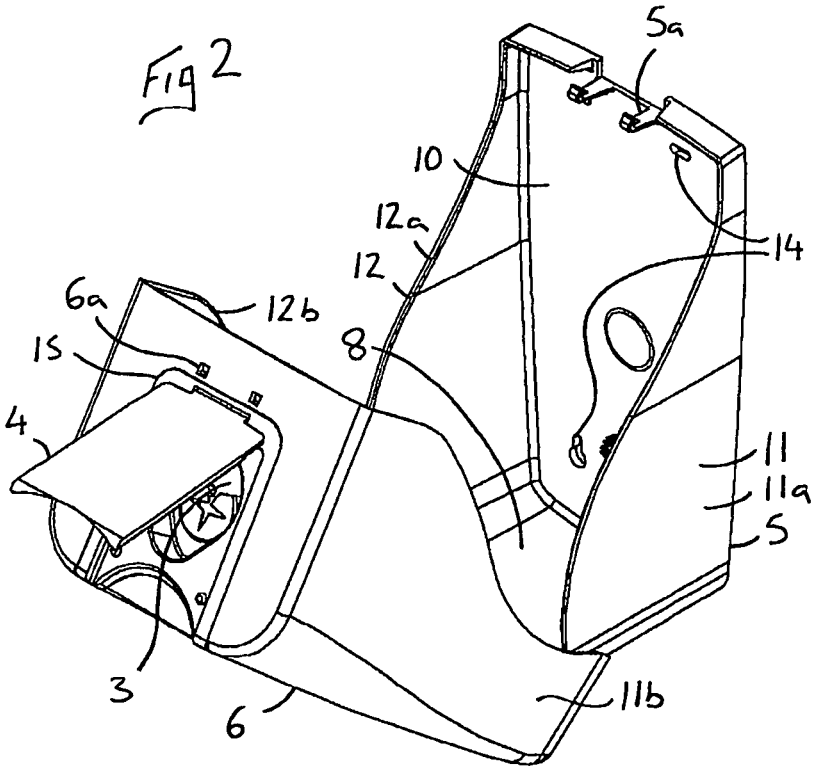
FIG. 2 is a perspective view of a sheets dispenser as shown in FIG. 1.
Figure 8:
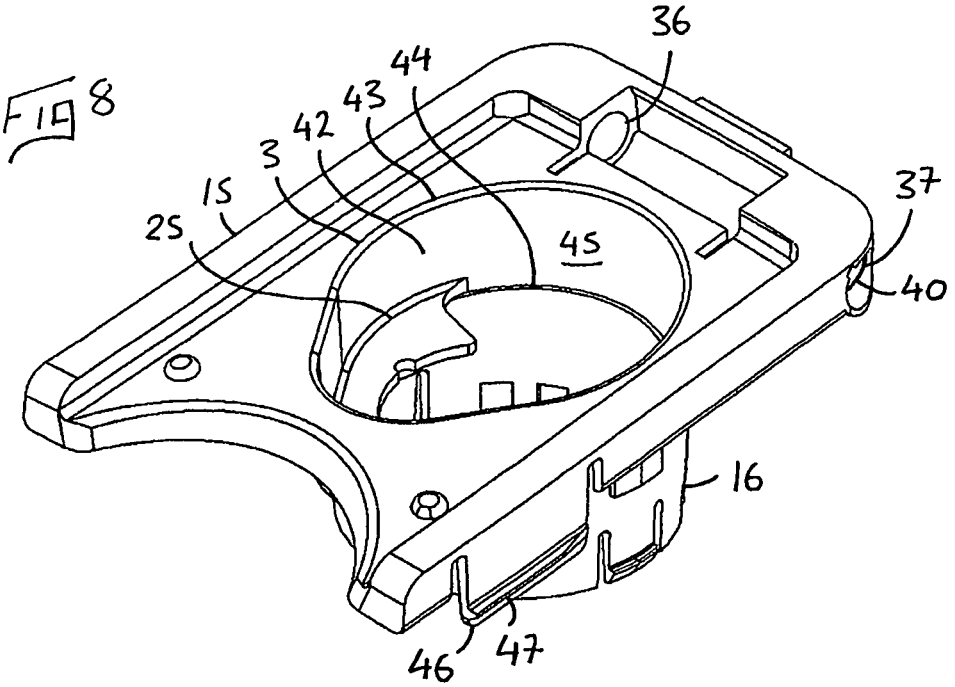
FIG. 8 is a perspective view of a main frame component of the sheets dispenser as shown in FIG. 1.

As is clear from FIGS. 1 and 2, the opening 3 is on the top side 7 of the cover 6. A main frame 15, as shown in FIGS. 5 and 8, is mounted on the top side 7 of the cover 6, and it defines the opening 3 and carries the spring loaded lid 4, as well as several other features of the invention as described below.

Figure 4:
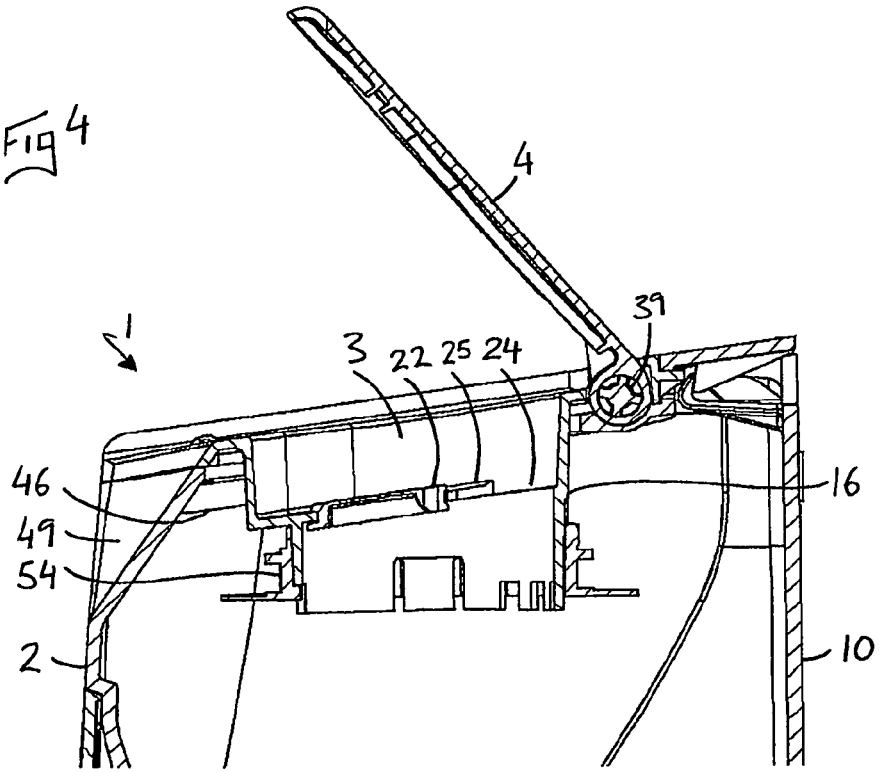
FIG. 4 is a part cross-sectional side view of the dispenser as shown in FIG. 1.
Figure 5:
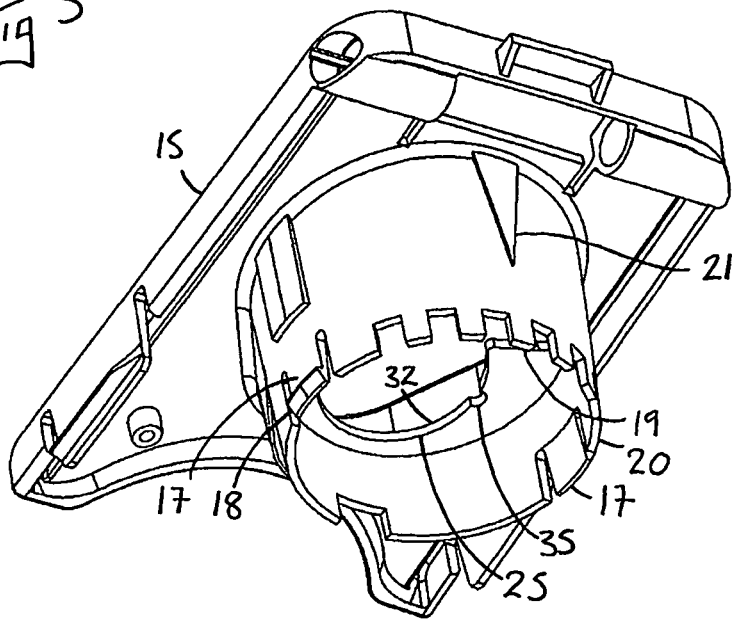
FIG. 5 is a perspective view of a main frame component of the sheets dispenser as shown in FIG. 1.

Referring now to FIGS. 3 to 5 mounting means, in the form of cylindrical boss 16 depends inwardly from said opening 3. The boss 16 is provided with resilient arms 17 with protrusions 18 at their ends. It is also provided with shaped profile 19 along its outer rim 20, and an indicator 21 on its outer surface. As is clear from FIGS. 3 and 4, the boss 16 is also slightly tapered.

Figure 6:
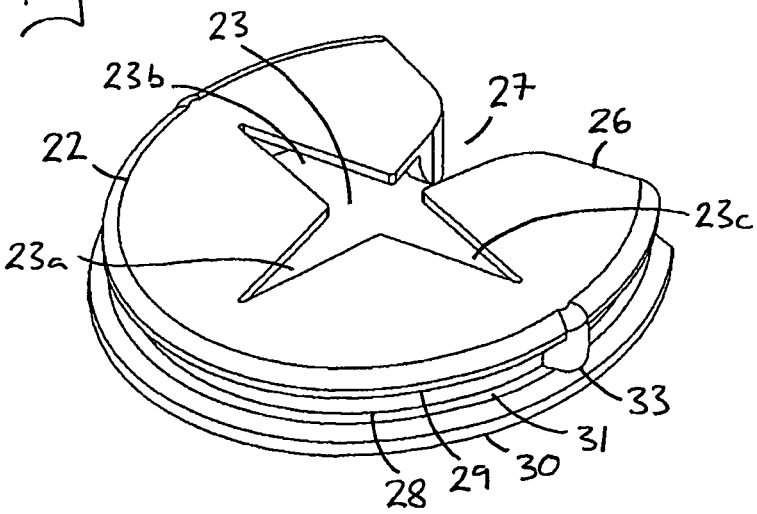
FIG. 6 is a perspective view of a panel component of the sheets dispenser as shown in FIG. 1.

A panel 22 is mounted in the opening 3, and the panel 22 carries extrusion means in the form of star shaped aperture 23. (The panel 22 is shown individually in FIG. 6). By its nature the aperture 23 comprises three tapering sections 23*a*, 23*b*, and 23*c*. The panel 22 only partly overlies the opening 3, such that open passage way 24 is provided adjacent the panel 22.

The panel 22 is resilient and is removably mounted to frame 25. As is clear from FIG. 6, the aperture 23 overlaps with an edge 26 of the panel 22, such that a lateral opening 27 is formed, which is collapsible. Thus, the panel 22 is laterally resilient, which allows it to be removably fitted to the frame 25 as described below.

The panel 22 also has downwardly depending edge wall 28 along its peripheral edge 26, an upper laterally extending flange 29 at a top of said edge wall 28, and a lower laterally extending flange 30 at a bottom of said edge wall 28, such that a trough 31 is formed which is adapted to receive a peripheral edge portion 32 of said frame 25 when the panel 22 is mounted therein, as shown in FIGS. 3 and 4.

In addition, two lugs, only one of which 33 is visible, extend from the upper flange 29 to the lower flange 31. The peripheral edge portion 32 of the frame 25 has two sockets, only one of which 35 is visible, which are adapted to receive the lugs 33 in use.

Figure 7:
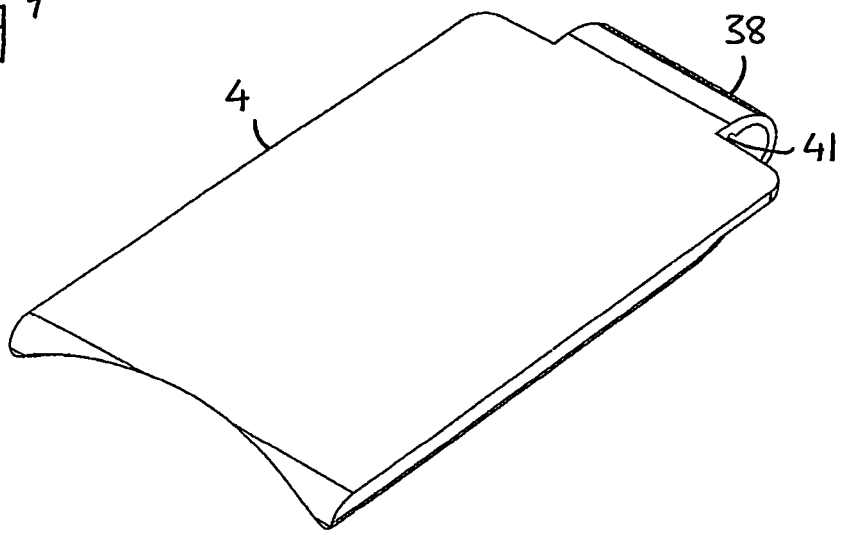
FIG. 7 is a perspective view of a lid component of the sheets dispenser as shown in FIG. 1.

The lid 4 is mounted to the container 2 by spring loaded hinge means. Referring to FIGS. 7 and 8 the hinge means comprises a pair of laterally spaced sockets 36 and 37 provided on the container 2 by way of the main frame 15, and a sleeve 38 provided on the lid 4, which is disposed between said sockets 36 and 37 and axially aligned thereto when the dispenser 1 is fully constructed as shown in FIG. 1. A pinion 39 (only shown in FIGS. 3 and 4) is threaded through the sockets 36 and 37 and the sleeve 38, via opening 40 on the outside of socket 37.

The pinion 39 is provided with a lug (not shown) which fits into slot 41 provided in the sleeve 38, such that the pinion 39 is non-rotatably attached to the sleeve 38. A coil spring (not shown) is attached at a first end to one end of the pinion 39, and a tension plug (also not shown) is attached to a second end of the spring, and the tension plug is non-rotatably fixed inside the socket 37. The coil spring is kept under tension in this position, such that the lid 4 is biased into a closed position.

As is most clear from FIG. 8, the opening 3 comprises a passageway 42 extending from a top 43, which is closable with the lid 4, to the mounting means 16. The frame 25 and the panel 22 are disposed at a bottom end 44 of the passageway 42, such that a chamber 45 is provided between the lid 4 and the frame 25 and the panel 22 when the lid 4 is in a closed position, as shown in FIG. 3.

The main frame 15 is provided with resilient arms 46 with protrusions 47 at their ends. These arms 46 allow the main frame to removably snap-fit together with the cover 6.

Referring back to FIG. 1, the lid 4 extends to an edge 48 of the container 2 where the top side 7 and the front side 9 meet, and a concavity 49 is provided in the front side 9 underneath said edge 48. This allows the lid 4 to be readily lifted from below.

Figure 9:
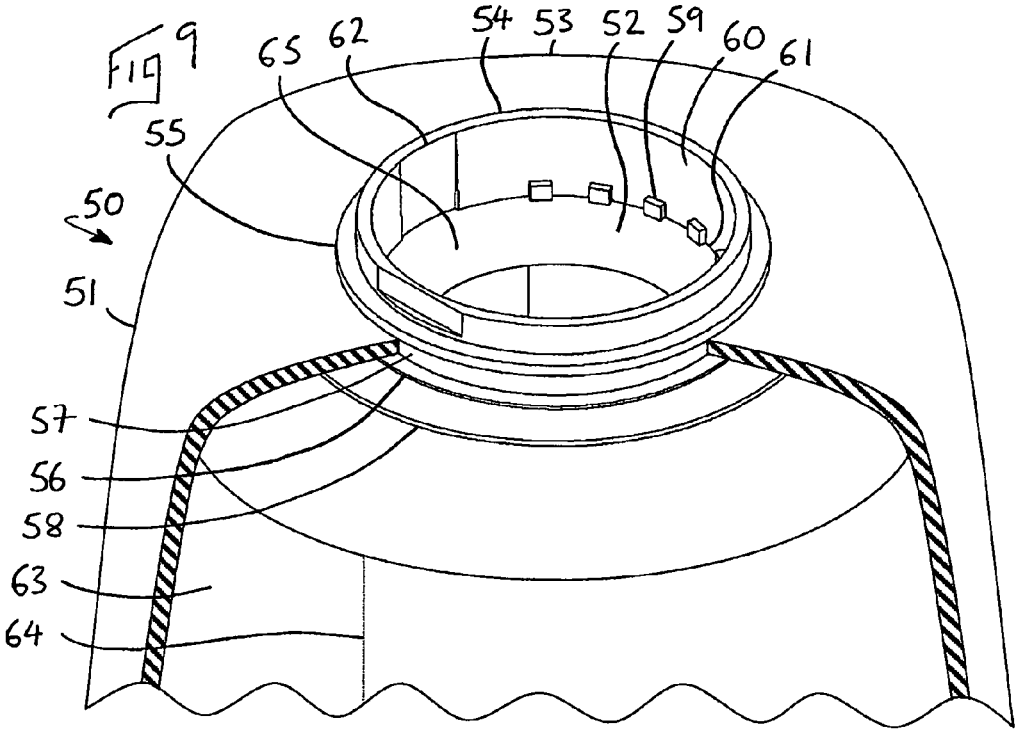
FIG. 9 is a part cross-sectional perspective view of an inner container according to a second aspect of the present invention.

In use as described below the dispenser 1 carries as inner container, and such a container 50 is shown in FIG. 9. The inner container 50 comprises a bag 51 with an aperture 52 at its top 53. The aperture 52 is maintained by a rigid collar 54.

The rigid collar 54 has an upper circumferential flange 55, and a lower circumferential flange 56, which together define a circumferential trough 57. The bag 51 is bonded to the trough 57, thereby to secure the collar 54 in the aperture 52. The lower circumferential flange 56 has an annular extension section 58 which extends laterally into the bag 51, and prevents the sides of the bag 51 from encroaching on the aperture 52. The collar 54 and its features are not shown in cross section in FIG. 9.

The collar 54 has a shaped profile 59 comprising a number of abutments, arranged on its inner surface 60 adjacent a lower rim 61. The collar 54 also has two slots, only one of which 62 is visible, on its inner surface 60. The other slot is opposite to slot 62. The inner surface 60 of the collar 54 is slightly tapered.

The inner container 50 carries wet wipes 63 (also not show in cross-section) to be dispensed. The wet wipes 63 are formed from a length of wet wipe material with perforated lines formed therein, one of which 64 is visible in FIG. 9. As such the wet wipes 63 are connected to one another end to end. As is clear from FIG. 9 the wet wipes 63 are arranged in a roll 65 inside the bag 51, which is axially aligned with the aperture 52. The wet wipes 63 are removed from the inside of the roll 65 in use.

In use the sheets dispenser 1 and the inner container 50 are used as follows.

First the container 2 is opened up as shown in FIG. 2. The cover 6 is lifted slightly to remove the catches 5*a* from the slots 6*a* in order to release them, and the cover 6 hinges down to the position shown in FIG. 2.

The inner container 50 is provided with a cover (not shown) which seals the aperture 52, which is removed for use. The inner container 50 is then placed inside the cover 6, and the collar 54 is connected to the boss 16. (FIGS. 3 and 4 show a collar 54 in position on the boss 16, but the inner container 50 is not shown in these Figures.)

An indicator (not visible in the Figures) provided on the collar 54 is aligned with indicator 21 on the boss 16, and the collar 54 is slid over the boss 16. The inner surface 60 of the collar 54 and the outer surface of the boss 16 have corresponding tapered surfaces, such that the collar 54 slides smoothly into position on the boss 16, as shown in FIGS. 3 and 4.

As the collar 54 is slid over the boss, the resilient arms 17 engage with the slots 62. The arms 17 are pushed inward until the protrusions 18 emerge from the slots 62, and hold the collar 54 in place on the boss 16 in a snap-fit arrangement.

Simultaneous with this movement, the shaped profile 59 on the collar 54 slots neatly into the shaped profile 19 on the boss 16. The shaped profiles 59 and 19 engage before the protrusions 18 emerge from the slots, so the correct profile 59 must be used for the collar 54 to fit onto the boss 16.

The cover 6 is then hinged back onto the base 5, and fastened in position as shown in FIG. 1. The lid 4 is then opened, and the first wet wipe 63 is pulled from the inner container 50, and threaded through the star-shaped aperture 23 in the panel 22. The first wet wipe 63 can be accessed via the open passageway 24, and can be placed against the aperture 23 from underneath using the fingers of one hand, and pulled through using the other hand.

If this proves too awkward, the panel 22 can be removed from the frame 25 to create a larger opening to access the first wet wipe 63. The first wet wipe 63 can then be threaded through the aperture 23 while the panel 22 is free of the frame 25, before the panel 22 is replaced therein. The panel 22 is removed from the frame 25 by compressing it laterally so the opening 27 collapses, and the trough 31 disengages with the peripheral edge portion 32 of the frame 25 and the lugs 33 disengage from the sockets 35. When the panel 22 is replaced in the frame 25 the reverse is performed.

The lid 4 is then released such that it rests in the closed position shown in FIG. 1, and the dispenser 1 is ready for use.

When a wet wipe 63 is required, first the lid 4 is opened by placing the fingers in the concavity 49 and lifting it from below. The first wet wipe 63, a portion of which is protruding from the aperture 23 can then be pulled through the aperture 23 to release it. The wet wipe 63 is subjected to different amounts of resistance depending on the angle it is pulled through the aperture 23. If it is pulled upwards, and therefore generally perpendicular to the aperture 23, it is subjected to a lower amount of resistance than if it is pulled laterally thereto. This is because if the wet wipe 63 is pulled upwards, it passes through the middle of the aperture 23 where there is more space than if it is pulled laterally and forced into one of the tapering sections 23*a* to 23*c* where there is less space. These different levels of resistance are employed to separate one wet wipe 63 from the next, and to leave a convenient portion of the next protruding from the opening 3.

Therefore, in the first instance a user pulls the first wet wipe 63 straight up and out of the opening 3. As is clear from FIGS. 3 and 4, the panel 22 is actually arranged at a slight forward angle, so it is easier to pull a wet wipe 63 through the aperture 23 substantially perpendicular thereto. When the first wet wipe 63 is clear of the aperture 23, the next will continue through it because the resistance provided by the aperture 23 is less than the force required to break the connection between the wet wipes 63.

In the second instance the user pulls the first wet wipe 63 more laterally, for example towards them, and as such the next wet wipe 63 will be pulled into the tapering section 23*a*. This is continued until the resistance increases above that required to break the perforation between the wet wipes 63, and the first breaks off from the next, leaving a convenient part of the next protruding from the aperture 23. The same can be achieved by pulling the first wet wipe 63 sideways into the tapering sections 23*b* or 23*c*. It may also be achieved by pulling the first wet wipe sideways against one of the points between the tapering sections 23*a* to 23*c*, which may snag against the next wet wipe and provide sufficient resistance.

It will be appreciated that the removal and separation of wet wipes 63 in this manner is not an exact science, and the moment when the resistance of the extrusion means exceeds the force required to separate the wet wipes 63 could vary according to numerous factors. For example, the wet wipes 63 are pulled from inside the bag 51 up to the panel 22 at a constantly changing angle, due to their arrangement in the roll 65. In addition, the manner in which the wet wipes 63 are collapsed to pass through the aperture 23 may constantly change.

It is also possible to separate the wet wipes 63 by simply applying a greater force in the same direction as the first wet wipe 63 is pulled through the aperture 23 in the first instance. This can be done by yanking the first wet wipe 63 away from the next.

In the event that the wet wipes 63 do not separate as desired for whatever reason, it is also very easy to break then apart using both hands. In the event that the wet wipes 63 separate too early and no convenient portion of the next is left protruding from the aperture 23, it is also possible to reach around the panel 22 and grab the next wet wipe 63 if necessary.

It will be appreciated that the variable resistance feature described above is advantageous in that more than one wet wipe 63 can be removed at a time if desired. For example, three wet wipes 63 in a line can be removed before they are pulled laterally and broken off from a fourth.

When the desired number of wet wipes 63 have been removed for use, the lid 4 is released and it closes the opening 3, which prevents the remaining wet wipes 63 in the inner container 50 from drying out. The section of the wet wipe 63 left protruding from the aperture 23 does not foul the lid 4, because it is contained with the chamber 45, which is provided specifically for that purpose. If the section of wet wipe 63 does protrude from the aperture 23 sufficient to foul the lid 4, it can easily be pushed down into the chamber 45 to prevent that from happening.

When the wet wipes 63 have all been used up, the container 2 can be opened up again as described above, the collar 54 can be disengaged from the boss 16, and inner container 50 can be disposed of. The upper sections of the arms 17 are pressed inward until the protrusions 18 clear the slots 62, and the collar 54 can be released. A replacement inner container 50 with further wet wipes 63 can then be placed in the container 2 as described above.

During use the aperture 23 may be subjected to flexing forces, and it may wear out or fail. However, it this happens, it can be released from the frame 25 as described above, and replaced with another.

In addition, as described above, wet wipes come in a number of varieties, and in particular a number of sizes and weights. As such differently shaped extrusion means are required. Thus, if the dispenser 1 is to be used with other wet wipes which require a differently shaped extrusion aperture, the panel 22 can be removed from the frame 25 as described above, and a suitable replacement panel can be fitted therein.

In use as described above the shaped profile 59 slots into the shaped profile 19, to allow the collar 54 to be fitted onto the boss 16. Thus, a collar with a differently shaped profile will not fit onto the boss 16. This ensures that only the correct specification of wet wipe is fitted to each particular dispenser, and also that any third party products will not fit.

If the dispenser is to change role such that a new shaped profile is needed, then the main frame 15 must be removed from the cover 6, and a replacement main frame with the correct shaped profile fitted in its place. The main frame 15 can be removed from the cover 6 by reaching inside and pressing the resilient arms 46 inward until the protrusions 47 clear the body of the cover 6, and the whole main frame 15 can be lifted free from the cover 6.

The main frame 15 can also be removed from the cover 6 as described above if the coil spring (not shown) needs to be tightened or replaced. It will be appreciated from the Figures that tension plug (not shown) is only accessible when the main frame 15 is removed from the cover, because the tension plug is mounted lateral to the opening 3 in socket 37.

The invention also includes an inner container specifically adapted for use with a dispenser as described above, and such an invention is supported by the inner container 50 as shown in FIG. 9 and as described above.

The dispenser 1 can be altered without departing from the scope of Claim 1. For example in one alternative embodiment (not shown) no inner container is provided, and the dispenser comprises a simple container with wet wipes placed therein. In another alternative embodiment (not shown), the dispenser contains dry sheets to be dispensed.

Thus, a sheets dispenser is provided which shuts automatically to prevent the contents from being exposed to atmosphere. In addition, a dispenser is provided which allows the first of a sequence of sheets to be readily accessed and threaded through an extrusion means. Further, a dispenser is provided with a lid which is not fouled in use by sheets protruding from an extrusion means. The sheets dispenser of the invention is also of a flexible construction which allows various components to be readily replaced if the need be. The dispenser of the invention is also provided with means to dispense different types of sheets, and to ensure that only the correct ones are fitted.

The invention claimed is:

1. A sheets dispenser comprising a container with an opening, an inner container disposed inside said container, and a spring loaded lid adapted to close said opening, in which the opening is provided with an extrusion means in a panel carried by said opening, said extrusion means is adapted to restrict the passage of a sheet to be dispensed, in which the lid is biased into a closed position, wherein the panel only partly overlies the opening, such that an open passage way is provided adjacent the panel, wherein the container comprises a substantially cylindrical mounting boss depending inwardly from said opening, said mounting boss being adapted to co-operate with a. substantially cylindrical collar provided in an aperture of said inner container, such that the inside of the inner container is accessible through the opening, wherein the mourning boss comprises a lower edge and an outer surface which faces radially away from said opening, and in which the mounting boss is provided with a shaped profile comprising a number of slots formed in said outer surface adjacent said lower edge and extending radially inwardly into said opening, wherein the collar comprises an upper and a lower rim, and an inner surface which faces radially towards the aperture, in which the collar is provided with a shaped profile comprising a number of abutments arranged on said inner surface adjacent said lower rim and extending radially inwardly into the aperture, and wherein the inner surface of the collar surrounds the outer surface of the mounting boss, with the abutments extending radially inwardly into the slots.

2. The sheets dispenser of claim 1 wherein the mounting boss is provided with snap-fit means adapted to retain said collar.

3. The sheets dispenser of claim 1 wherein the mourning boss is provided with an indicator adapted to align with an indicator provided on said collar when said shaped profiles are aligned for co-operation.

4. The sheets dispenser of claim 3 wherein the mounting boss is tapered.

5. The sheets dispenser of claim 4 wherein the opening carries said panel, in which the extrusion means comprises a shaped aperture formed in said panel, which shaped aperture is adapted to restrict the passage of a sheet to be dispensed.

6. The sheets dispenser of claim 5 wherein the shaped aperture is adapted to provide different amounts of resistance at different parts.

7. The sheets dispenser of claim 6 wherein the shaped aperture comprises at least one tapering section.

8. The sheets dispenser of claim 7 wherein the shaped aperture is substantially star shaped.

9. The sheets dispenser of claim 8 wherein the panel is removable from said opening.

10. The sheets dispenser or claim 9 wherein the opening comprises a frame adapted to carry said panel, in which the panel is resilient, and in which the panel is removable from said frame when it is placed under compression.

11. The sheets dispenser of claim 10 wherein the shaped aperture is substantially star shaped and overlaps with an edge of the panel, such that a lateral opening in the aperture is formed, which lateral opening is at least partially collapsible.

12. The sheets dispenser of claim 9 wherein the panel is provided with a downwardly depending wall along its peripheral edge, an upper laterally extending flange at a top of said edge wall, and a lower laterally extending flange at a bottom of said edge wall, such that a trough is formed which is adapted to receive a peripheral edge portion of said frame, in which one or more lugs extend from said upper flange to said lower flange and in which the peripheral edge portion of said frame comprises one or more sockets adapted to receive said one or more lugs.

13. The sheets dispenser of claim 5 wherein the opening comprises a passageway extending from a top, which is closable with the lid, to the mounting means, and in which the panel is disposed at a bottom end of the passageway, such that a chamber is provided between the lid and the panel when the lid is in a closed position.

14. The sheets dispenser of claim 1 wherein the container comprises a base and a cover hinged thereto, in which the opening is provided on the cover.

15. The sheets dispenser of claim 14 wherein the container is generally shaped as a rectangular box with a top side, a bottom side, a front side, a back side, a left side and a right side, in which the base comprises at least said back side and said bottom side, in which the cover comprises at least said front side and said top side, in which the cover is hinged to the base adjacent an edge where the bottom side and the front side meet, and in which the opening is provided on the top side.

16. The sheets dispenser of claim 15 wherein the has comprises a first part of the left side and a first part of the right side, and in which the cover comprises a second part of the left side which overlaps with said first part of the left side when the container is shut, and a second part of the right side which overlaps with said first part of the right side when the container is shut.

17. The sheets dispenser of claim 15 wherein the lid extends to an edge where the top side and the front side meet, and in which a concavity is provided on the front side underneath said edge.

18. The sheets dispenser of claim 15 wherein the back side of the base is wall mountable.

19. The sheets dispenser or claim 1 wherein the lid is mounted to the container by spring loaded hinge means comprising a pair of laterally spaced sockets provided on the container, a sleeve provided on the lid disposed between said sockets and axially aligned thereto, and a spring loaded pinion disposed in said sockets and said sleeve.

20. The sheets dispenser of claim 19 wherein the pair of laterally spaced sockets, the pinion, the coil spring and a tension plug are all carried on a main frame attached to the cover.

21. The sheets dispenser of claim 20 wherein the main frame is removably attached to the cover in a snap-fit arrangement.

22. The sheets dispenser of claim 21 wherein the main frame also carries the mounting means and the extrusion means.

23. The sheets dispenser of claim 22 wherein the sheets to be dispensed are connected to one another in a sequence by connection means, and in which a force required to sever the connection means is less than a force required to pull a sheet through the extrusion means.

24. The sheets dispenser of claim 7 wherein said inner container contains sheets to be dispensed, in which the sheets to be dispensed are connected to one another in a sequence by connection means, and in which the extrusion means is adapted to provide a first level of resistance in a first instance which is less than a force required to separate the sheets, and a second level of resistance in a second instance which is greater than a force required to separate the sheets.

25. The sheets dispenser of claim 23 wherein the sheets are wet wipes.

26. An inner container tor use solely with a sheets dispenser of claim 1 wherein the inner container comprises an aperture maintained by a substantially cylindrical collar, in which said collar is adapted to mount to a mounting boss of said sheets dispenser, and in which the inner container contains sheets to be dispensed.

27. The inner container of claim 26 wherein said collar is provided with a shaped profile adapted to co-operate with a corresponding shaped profile provided on said mounting boss.

28. The inner container of claim 27 wherein the sheets to be dispensed are connected to one another in a sequence by connection means.

* * * * *